US007568436B2

(12) United States Patent
McAllister et al.

(10) Patent No.: US 7,568,436 B2
(45) Date of Patent: Aug. 4, 2009

(54) ADJUSTABLE MULTI-COMPONENT CONICAL CORNER STRUCTURE FOR SHELVING

(75) Inventors: Larry N. McAllister, Dover, DE (US); William L. Bartz, Jr., Dover, DE (US); Kenneth S. Christianson, Clayton, DE (US)

(73) Assignee: Metal Masters Foodservice Equipment Co., Inc., Clayton, DE (US)

( * ) Notice: Subject to any disclaimer, the term of this patent is extended or adjusted under 35 U.S.C. 154(b) by 364 days.

(21) Appl. No.: 11/585,537

(22) Filed: Oct. 24, 2006

(65) Prior Publication Data

US 2008/0092787 A1 Apr. 24, 2008

(51) Int. Cl.
*A47B 9/08* (2006.01)

(52) U.S. Cl. ..... 108/147.12; 108/147.13; 108/107; 211/187

(58) Field of Classification Search ..... 108/106, 108/107, 147.11–147.17; 211/187, 181.1, 211/153, 182, 90.01–90.04
See application file for complete search history.

(56) References Cited

U.S. PATENT DOCUMENTS 4,615,278 A * 10/1986 Cabrelli ..... 108/192
4,637,323 A * 1/1987 Nicely ..... 108/107
4,706,576 A * 11/1987 James ..... 108/192
4,750,626 A 6/1988 Nicely
4,811,670 A * 3/1989 Kolvites et al. ..... 108/107
4,964,350 A * 10/1990 Kolvites et al. ..... 108/110
5,002,247 A * 3/1991 Dispenza et al. ..... 248/188
5,390,803 A 2/1995 McAllister
D395,000 S 6/1998 Bartz, Jr.
5,884,567 A 3/1999 Bartz, Jr.
6,015,052 A * 1/2000 Goldberg et al. ..... 211/187
6,253,687 B1 7/2001 McAllister
7,059,484 B1 * 6/2006 Goldberg ..... 211/187

FOREIGN PATENT DOCUMENTS

JP 2007175224 * 7/2007

* cited by examiner

*Primary Examiner*—Janet M Wilkens
(74) *Attorney, Agent, or Firm*—Connolly Bove Lodge & Hutz LLP

(57) ABSTRACT

A shelving system comprises a plurality of upright support posts, a shelf having multiple corners and adjustable multi-component corner structure at each corner of the shelf for connecting the shelf to the posts. Each corner structure includes a base segment movably and adjustably connected to the shelf and an outside segment releasably secured to the base segment. The base segment is adjustable with respect to the shelf for proper alignment and connection of the corner structures to the posts.

4 Claims, 7 Drawing Sheets

ADJUSTABLE MULTI-COMPONENT CONICAL CORNER STRUCTURE FOR SHELVING

BACKGROUND OF THE INVENTION

The present invention relates to shelving and, more specifically, to improved shelving having adjustable multi-component conical corner structure which facilitates the mounting on or removal of a shelf relative to upstanding corner post without the necessity of initially removing adjacent shelves connected to the posts.

Adjustable shelving units employing shelves constructed of sheet metal or wire are well known and extensively utilized. They are particularly intended to be readily assembled and disassembled. For this purpose, the shelving unit normally utilizes a corner structure for securing the shelves to upright posts. In situations where strength and rigidity of the assembled shelving unit is of significance, the corner structure generally employs a conical collar arrangement which totally surrounds the corner post to achieve a secure and rigid clamping engagement with the post. Such corner structure, however, not only makes assembly of the shelving unit more complex since the conical collar must be slidably inserted over the post from one end, but this corner structure also makes partial disassembly or rearrangement of the shelves more difficult. For example, with most known shelving units employing a corner structure of this type, the corner structure does not permit a bottom or intermediate shelf to be mounted on or removed from the posts after the shelving unit has been assembled due to the inability to position a corner structure in surrounding relationship to the post. Hence, the entire shelving unit must be reassembled.

A known shelving unit of the above type which has achieved significant commercial success provides conical collar corner structures which telescope downwardly over upstanding support posts, and conical clamping sleeves which are normally diametrically split into two pieces and which are wedgingly interposed between the collars and posts. This arrangement, wherein the intermediate conical clamping sleeve is utilized, has proven desirable inasmuch as this positively ensures a positive wedging and hence secure engagement of the shelf with respect to the posts so as to provide an extremely strong connection. The shelving units employing this intermediate conical sleeve, however, have still normally possessed features which have been considered undesirable with respect to the required assembly and disassembly techniques, the inability to add or remove intermediate shelves, and the general overall structural and functional complexities associated with some of the collar structures.

Multi-component corner constructions has been proposed which enable an intermediate shelf to be added or removed without initially removing adjacent shelves such as disclosed in U.S. Pat. No. 4,750,626. A two piece corner structure at each of the four corners of a shelf permits the shelf to be connected to or removed from four supporting corner posts without the necessity of removing the shelving directly above or below in the overall shelving system. However, the corner constructions of the prior art are fixed relative to the shelving to which they are connected, and alignment of the corners with the supporting posts is problematic.

SUMMARY OF THE INVENTION

Accordingly, it is an object of the present invention to provide an improved adjustable shelving unit, specifically a metal shelving unit, having an improved corner structure co-acting between the shelves and the upstanding support posts, which corner structure permits and retains the utilization of a intermediate conical clamping sleeve interposed between the post and the corner structure, but at the same time this improved corner structure overcomes many of the disadvantages associated with prior shelving units of this general type. More specifically, the improved corner structure of the present invention facilitates the assembly and disassembly of the shelves, including the assembly or disassembly of an intermediate shelf with respect to an assembled shelving unit, and permits the corner structure to be efficiently and economically fabricated while at the same time providing not only greatly increased flexibility but also providing a compact corner structure having a desirable appearance when assembled into the shelving unit.

Also included among the objects of the present invention is a corner structure which is movable relative to the shelving to which it is attached to facilitate adjustment and alignment with respect to the upright support posts when the shelf is secured thereto.

In accordance with the present invention, a shelving system comprises a plurality of upright support posts, a shelf having multiple corners, and adjustable multi-component corner structure at each corner of the shelf for connecting the shelf to the posts. Each corner structure includes a base segment movably and adjustably connected to the shelf and an outside segment releasably secured to the base segment. It is significant that the base segment is adjustable with respect to the shelf for proper alignment and connection of the corner structures to the posts. Moreover, if the base segment is damaged, it can be removed from the remainder of the shelf and replaced with a new segment.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawings wherein similar reference characters refer to similar parts and in which.

DETAILED DESCRIPTION OF THE INVENTION

Figure 1:
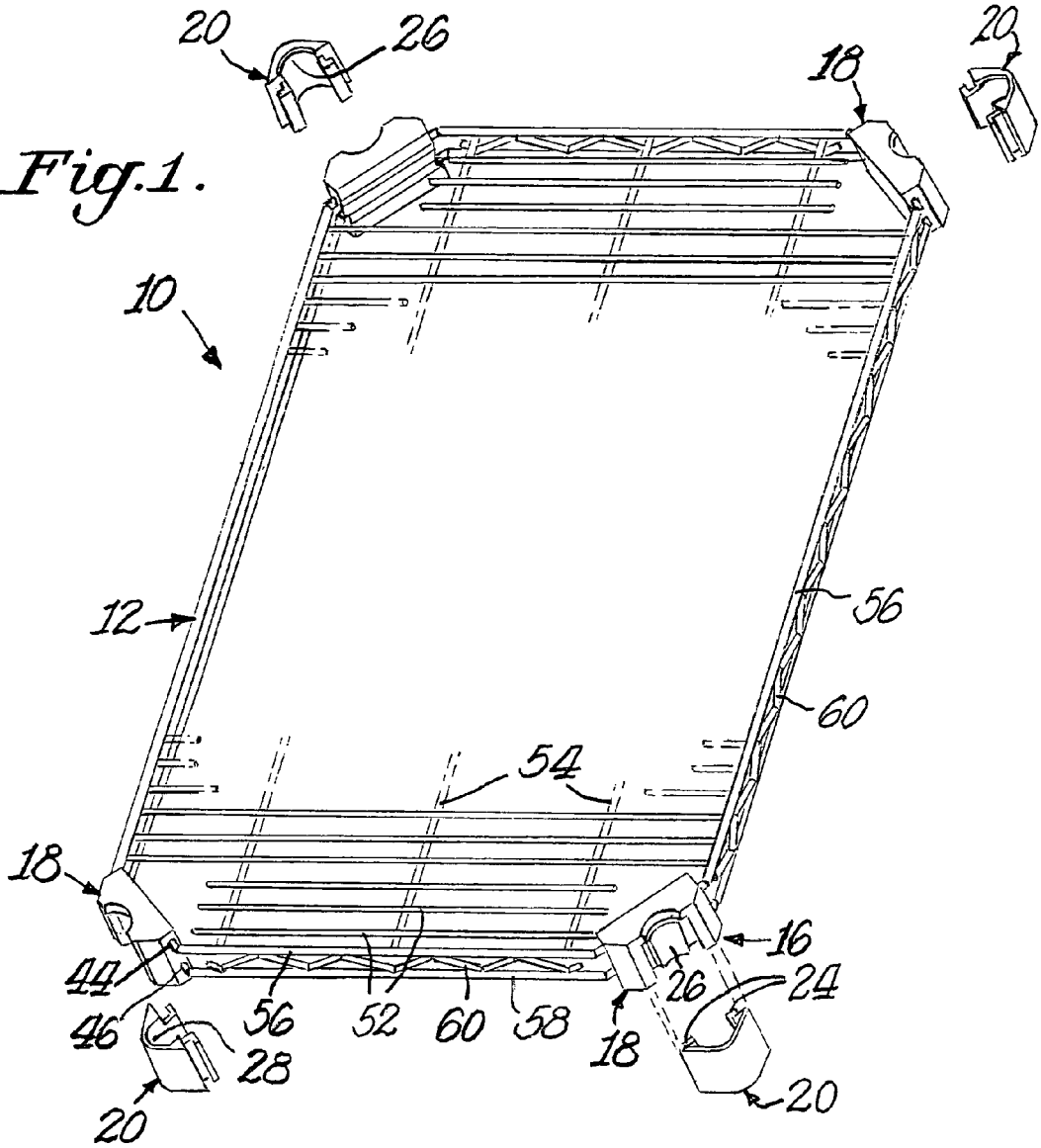
FIG. 1 is an exploded perspective view of a shelf with adjustable multi-component conical corner structures, according to the present invention.
Figure 2:
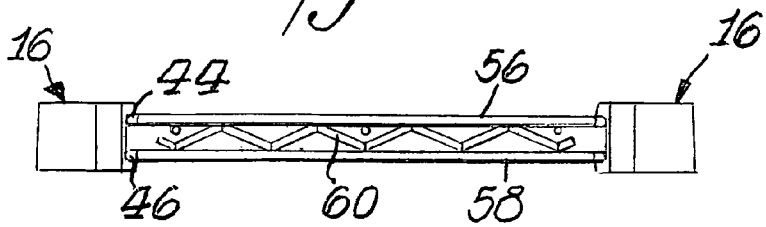
FIG. 2 is a side elevational view of the shelf shown in FIG. 1.
Figure 3:
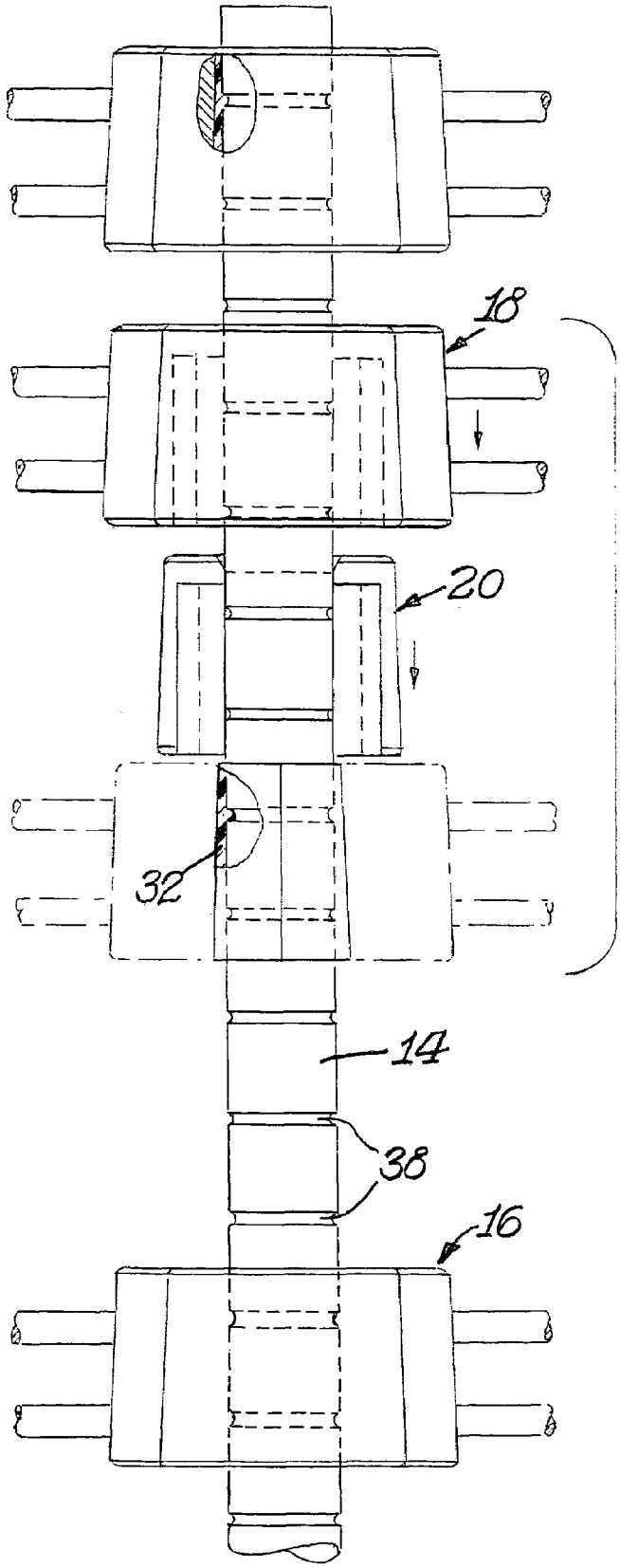
FIG. 3 is an elevational view of one upright shelf supporting post with shelving corner structures releasably secured thereto.
Figure 5:
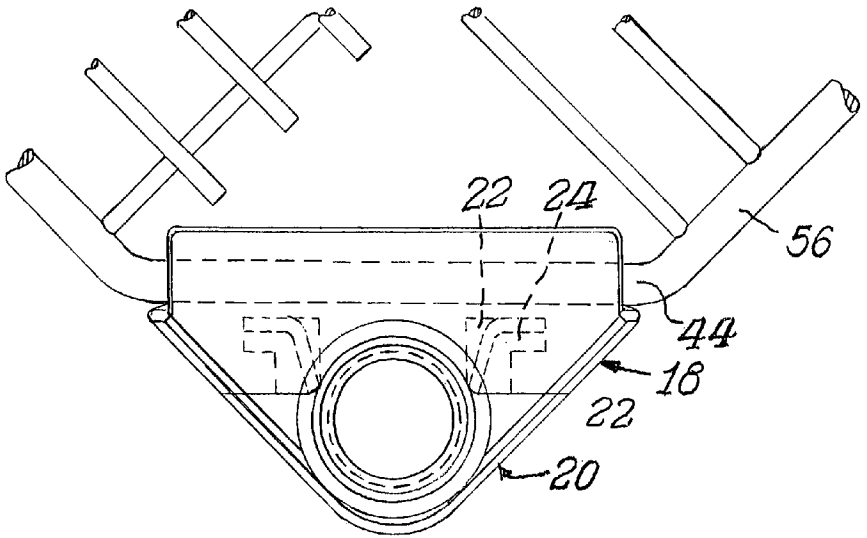
FIG. 5 is a top plan view of the shelf and post shown in FIG. 4.
Figure 4:
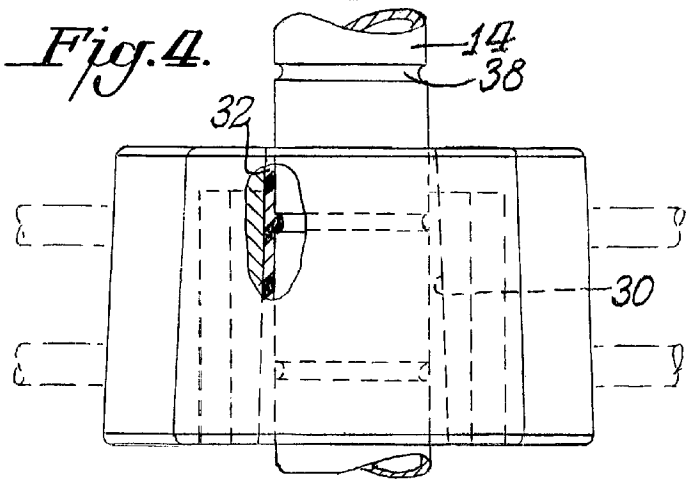
FIG. 4 is an elevational view of one of the shelf corner constructions releasably secured to an upright shelf supporting post.

Referring in more particularity to the drawings, FIGS. 1-3 illustrate an adjustable shelving unit 10 according to the present invention. Shelving unit 10 includes a plurality of substantially horizontal shelves 12 arranged in parallel relationship to one another with vertically spacing between adjacent shelves. The shelves 12 are supported by a plurality of upright support posts 14, and in the embodiment illustrated in the drawings, four posts are used with one post at each corner of the substantially rectangular shelves 12. As explained more fully below, the corner of each shelf 12 includes corner structure 16 for releasable attachment to a respective support post 14.

The corner structure 16 of the present invention basically comprises a base segment 18 adjustably connected to the shelf 12 and a separate outside interlocking segment 20 constructed and arranged for releasable attachment to the base segment. In this regard, the base segment 18 includes a pair of vertically oriented undercut slots 22 and the interlocking segment 20 includes a pair of opposite outwardly extending flanges 24 engaged within the slots when the base and interlocking segments of the corner structure 16 are assembled. The base segment 16 further includes an inside partial frusto conical surface 26 while the outside interlocking segment 20 also includes an inside partial frusto conical surface 28. When the base segment and the outside interlocking segment are assembled together with the flanges 24 in the slots 22 the surfaces 26, 28 form a frusto conical passageway 30.

Securement of the shelves 12 to the posts 14 is accomplished with the aid of a diametrically split two piece frusto conical collar 32 having a cylindrical inside surface 34 and a frusto conical outside surface 36. The posts 14 include a series of equally spaced apart annular recesses 38 along the length thereof, and the frusto conical collar 32 includes inwardly directed structure 36 on the inside surface thereof that engages a selected annular recess 38 of the post. Such structure 36 may include an annular projection 40 or one or more smaller projections spaced apart from one another on the inside of the collar. Once the collars 32 are so positioned around the posts, the frusto conical surfaces 26, 28 of the corner structure 16 fit over and against the frusto conical surface 36 of the collar 32.

Figure 6:
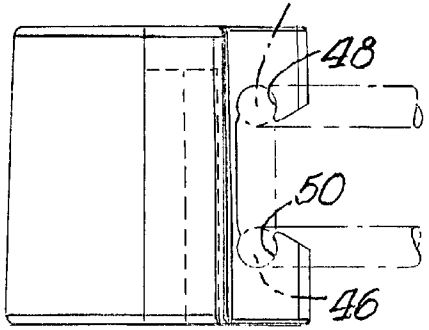
FIG. 6 is a side elevational view of the shelf and post shown in FIGS. 4 and 5.

As noted above and as shown in FIG. 1, the shelf 12 has a generally rectangular configuration, and each corner includes an angled portion 42 at approximately 45° to the sides and ends of the shelf. As shown in FIGS. 1 and 6, for example, each angled portion 42 of shelf 12 comprises upper and lower horizontal corner rods 44, 46, respectively. The inside portion of each base segment 18 is secured to the corner rods 44, 46 by upper and lower undercut portions 48, 50 that wrap around the rods as shown in FIG. 6.

Figure 16:
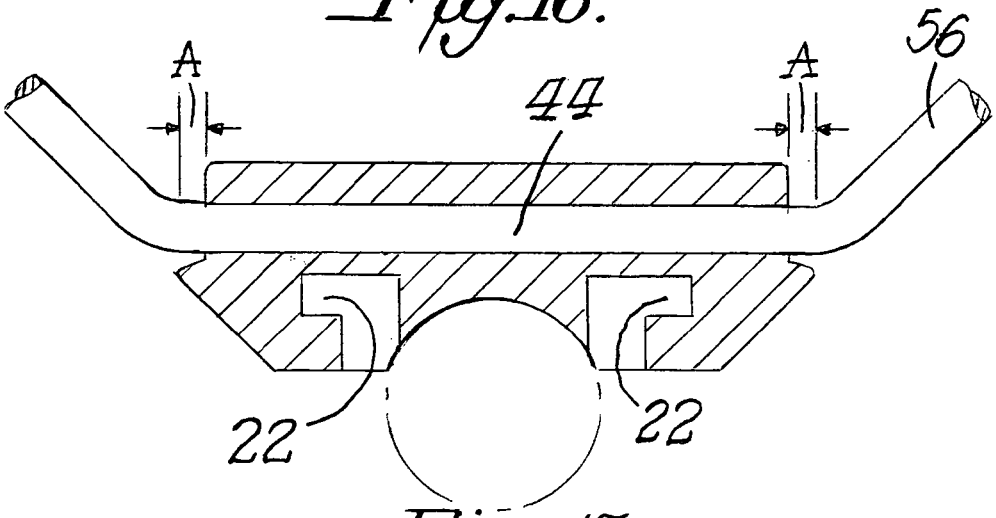
FIG. 16 is a cross-sectional top plan view of the base segment shown in FIG. 12 movably secured to the shelf with adjustment spaces A-A which enable alignment of the shelf with the upright posts.
Figure 17:
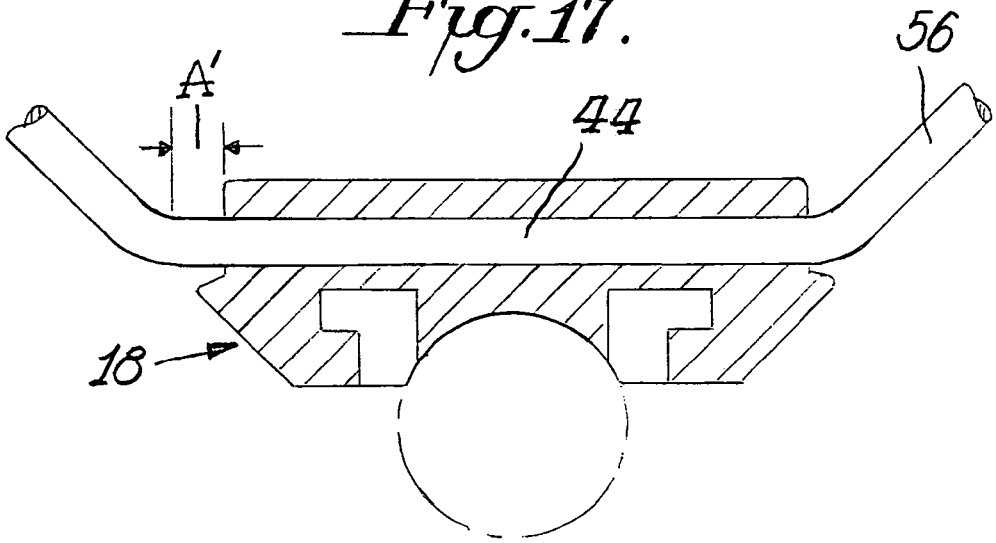
FIG. 17 is a cross-sectional top plan view similar to FIG. 16 but showing the corner construction shifted to the right by the dimension A' relative to the shelf for proper alignment of the corner with the upright support post.

The lower corner rod 46 may be positioned in the lower undercut portion 50 and the upper corner rod is then snapped into place to thereby position the upper rod in the upper undercut portion 48. The connection of the base segment 18 to the wire shelf and the length of the corner rods 44, 46 is constructed and arranged to allow the base segment 18 to slidably move along the rods to thereby adjust the position of each corner structure 16 relative to the shelf. As shown in FIGS. 16 and 17, the base segment 18 may be centrally positioned on the corner rods 44, 46 with a space A on each side thereof. However, it is also possible to slide the base segment 18 to the right or left by the distance A, and in FIG. 17 base segment 18 has been moved to the extreme right leaving a space A' on the left approximately equal to twice the spacing A. This adjustment of the corner structure 16 relative to shelf 12 is extremely useful for proper alignment and connection of the corner structures 16 to the posts 14.

Shelf 12 is formed by a plurality of transverse members 52 spaced apart from one another in general parallel relationship to form a plane. A plurality of longitudinal members 54 are attached by spot welding, for example, along their length at points of connection to the transverse members 52. Upper and lower rods 56, 58 extend around the periphery of the shelf, and serpentine members 60 extend between the rods 56 and 58, as shown. The upper and lower corner rods 44, 46 may comprise portions of the upper and lower peripheral rods 56, 58.

The corner structure 16 of the present invention comprising base segment 18 and outside interlocking segment 20 enables shelf removal or addition without the necessity of removing adjacent shelving of the unit 10. In this regard, for shelf removal, each outside interlocking segment 20 is simply separated from its respective base segment 18 by slightly lifting the shelf and the base segments secured thereto away from the interlocking segments 20. Thereafter the shelf 12 is tilted and removed away from the support posts 14.

The reverse applies when a shelf 12 is being added to the shelving unit 10. During such addition the adjustability of the corner structure 16 relative to the shelf being added enables adjustment of the base segment 18 relative to the shelf along the corner rods 44, 46 to facilitate proper alignment and connection of the base segment to the outside surface 36 of the frusto conical collar 32 and the interlocking segment 20.

Figure 10:
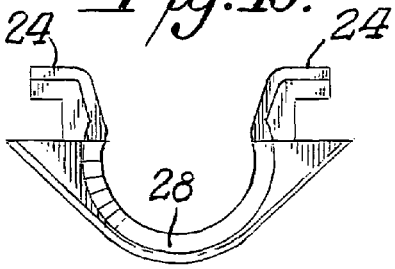
FIG. 10 is a top plan view thereof.
Figure 7:
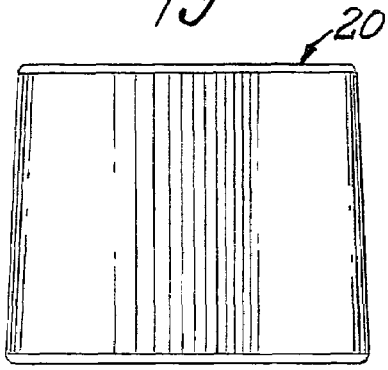
FIG. 7 is a front elevational view of the removable outside interlocking segment of the shelf corner construction, according to the present invention.
Figure 8:
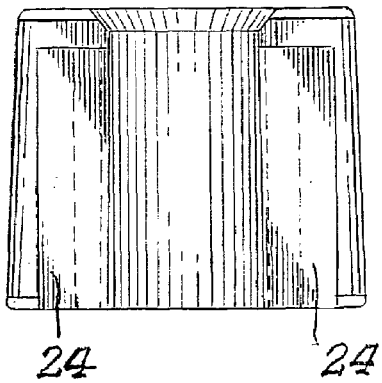
FIG. 8 is a rear elevational view thereof.
Figure 9:
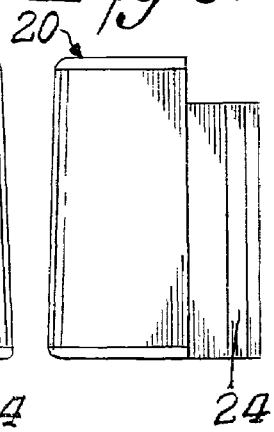
FIG. 9 is a right side elevational view thereof.
Figure 11:
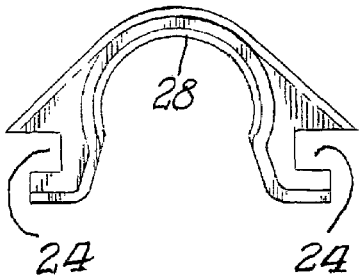
FIG. 11 is a bottom plan view thereof.
Figure 14:
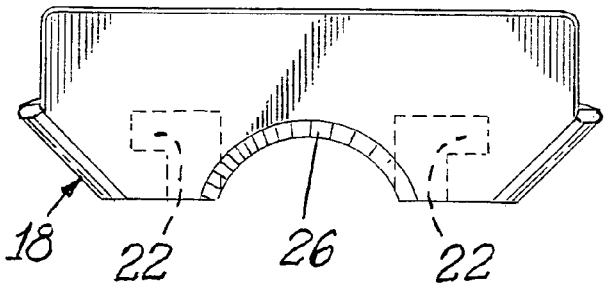
FIG. 14 is a top plan view thereof.
Figure 12:
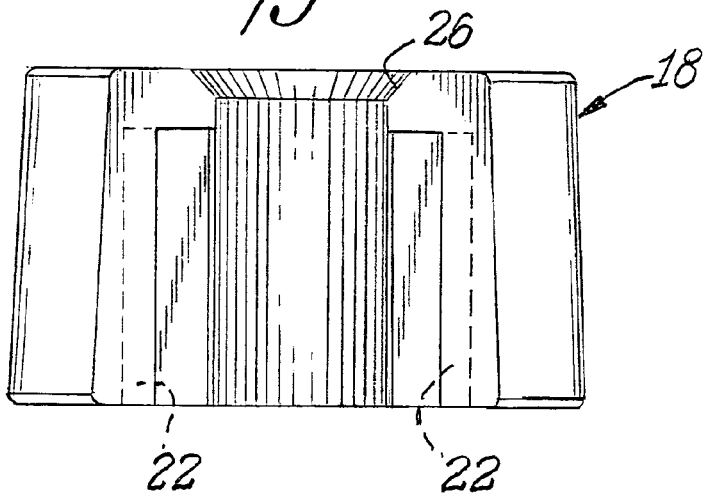
FIG. 12 is front elevational view of the base segment of the shelf corner construction, according to the present invention.
Figure 13:
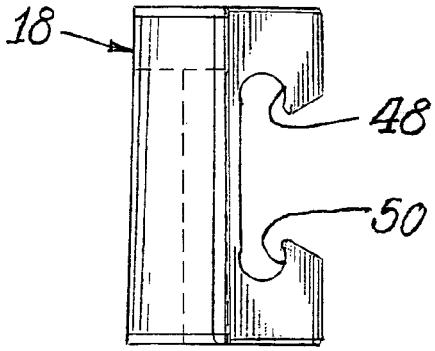
FIG. 13 is a right side elevational view thereof.
Figure 15:
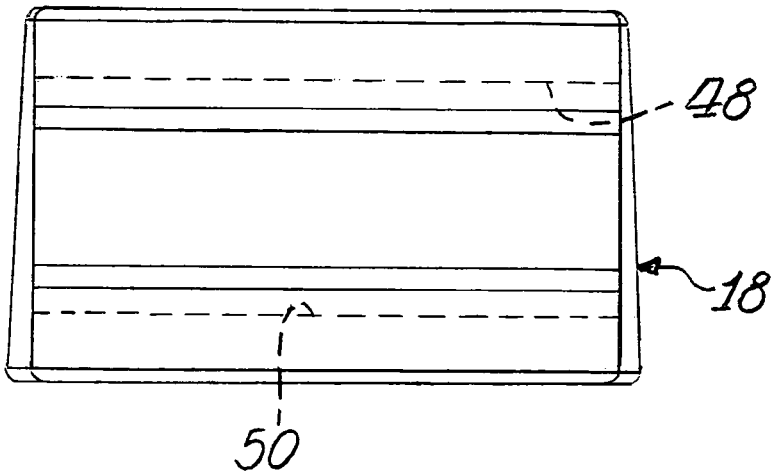
FIG. 15 is a rear elevational view thereof.

Initially, when adding a shelf to the assembly, four collars 32 are attached to the posts 14 at the desired elevation of the shelf. An interlocking segment 20 is then positioned over each collar 32 so that the frusto conical surface 28 of the interlocking segment engages the outside frusto conical surface of the collar. Each interlocking segment 20 is retained on its respective collar because the interlocking segment extends slightly more than 180° around the collar as is evident from FIG. 10. Next, the shelf being added is lowered onto the interlocking segments 20 and the collars 32 until the flanges 24 on the interlocking segments fully engage within undercut slots 22 of the base segments 18. Proper alignment of the flanges and undercut slots is accomplished by adjustment of the base segment 18 relative to the shelf by moving the base segments along the corner rods 44, 46.

Figure 18:
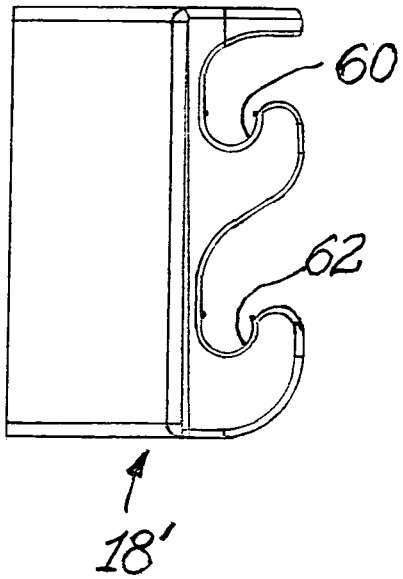
FIG. 18 is a right side elevational view of an alternate base segment of the shelf corner construction, according to the present invention.
Figure 19:
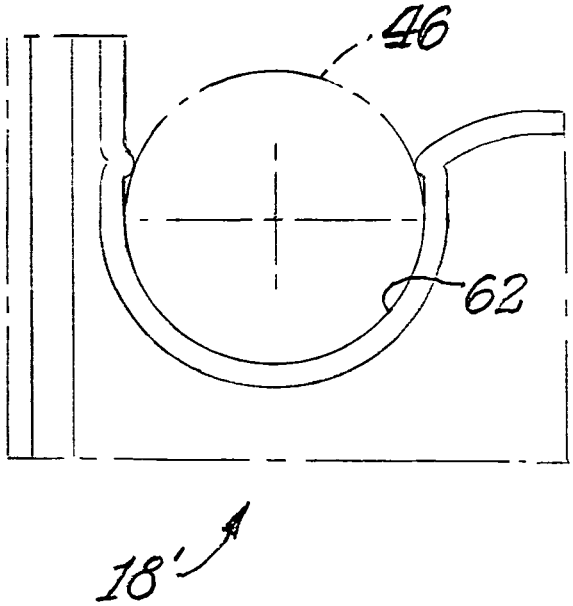
FIG. 19 is an enlarged partial right side elevational view of the alternate base segment of FIG. 18 showing retainment of one corner rod to the rear surface of the base segment.

FIGS. 18 and 19 illustrate an alternate base Segment 18' similar in all major respects to base segment 18 except for the attachment of the upper and lower corner rods 44, 46, respectively, to the inner portion of each base segment 18'. Specifically, base segment 18' includes upper and lower horizontal undercuts 60, 62 respectively, for receiving the upper and lower corner rods. The corner rods simple snap fit into the undercuts 60, 62, as shown in FIG. 19. Each undercut engages a corner rod over slightly more than 180° of its surface to provide the snap fit. Otherwise, horizontal adjustment movement of base segment 18' along corner rods 44, 46 is the same as shown in FIGS. 16 and 17 in connection with base segment 18.

We claim:

1. A shelving system comprising a plurality of upright support posts, a shelf having multiple corners, an adjustable multi-component corner structure at each corner of the shelf for connecting the shelf to the posts, each corner structure including a base segment movably and adjustably connected to the shelf and an outside interlocking segment releasable secured to the base segment whereby the base segment is adjustable with respect to the shelf for proper alignment and connection of the corner structures to the posts, and further including a frusto conical collar connected to each post at an elevation where a shelf is to be positioned, the frusto conical collar having a frusto conical outside surface, and wherein the base and interlocking segments of each corner structure include frusto conical surface portions that engage the outside surface of the collars when the base and interlocking segments are releasably connected together.

2. A shelving system as in claim 1 wherein each base segment includes undercut slots and each interlocking segment includes outwardly directed flanges that engage within the slots when the base and interlocking segments are releasably connected together.

3. A shelving system as in claim 2 wherein the interlocking segment of each corner structure extends slightly more than 180° around its associated frusto conical collar.

4. A shelving system as in claim 1 wherein the base segment of each adjustable multi-component corner structure is slidably mounted to the shelf.

* * * * *